US005318118A

United States Patent [19]

Duell

[11] Patent Number: 5,318,118

[45] Date of Patent: Jun. 7, 1994

[54] CUP TYPE CASING PACKER CEMENTING SHOE

[75] Inventor: Alan B. Duell, Duncan, Okla.

[73] Assignee: Halliburton Company, Duncan, Okla.

[21] Appl. No.: 848,556

[22] Filed: Mar. 9, 1992

[51] Int. Cl.[5] ..... E21B 33/126

[52] U.S. Cl. ..... 166/202; 166/318

[58] Field of Search ..... 166/51, 127, 137, 179, 166/202, 291, 374, 318

[56] References Cited

U.S. PATENT DOCUMENTS

| | | |
|---|---|---|
| 1,563,162 | 11/1925 | Christenson . |
| 2,200,943 | 5/1940 | Wilseon et al. . |
| 2,305,282 | 12/1942 | Taylor et al. . |
| 2,546,978 | 4/1951 | Collins et al. . |
| 2,585,706 | 2/1952 | Ware . |
| 2,602,511 | 7/1952 | Johnson . |
| 2,672,199 | 3/1954 | McKenna . |
| 2,674,315 | 4/1954 | Brown . |
| 2,813,589 | 11/1957 | Woodruff . |
| 2,829,717 | 4/1958 | Brown . |
| 3,010,518 | 11/1961 | Harmon . |
| 3,131,767 | 5/1964 | Chancellor et al. . |
| 3,391,743 | 7/1968 | Bateman . |
| 3,524,503 | 8/1970 | Baker . |
| 3,527,299 | 9/1970 | Lewis . |
| 3,768,556 | 10/1973 | Baker . |
| 4,149,566 | 4/1979 | Stowe . |
| 4,407,369 | 10/1983 | Hutchison . |
| 4,431,058 | 2/1984 | Spencer . |
| 4,469,174 | 9/1984 | Freeman . |
| 4,961,465 | 10/1990 | Brandell . |
| 5,117,910 | 6/1992 | Brandell et al. ..... 166/291 |

*Primary Examiner*—Ramon S. Britts
*Assistant Examiner*—Frank S. Tsay
*Attorney, Agent, or Firm*—James R. Duzan

[57] ABSTRACT

An improved cup type packer cementing shoe comprising a single pump-out seat and all elastomeric sealing cups.

4 Claims, 2 Drawing Sheets

CUP TYPE CASING PACKER CEMENTING SHOE

BACKGROUND OF THE INVENTION

This invention relates to an improved cup type casing packer cementing shoe. More specifically, this invention relates to an improved cup type casing packer cementing shoe having a single pump-out seat and all elastomeric sealing cups.

Typically, casing packer cementing shoes and stage cementing collars have been used which employ compression set type packer elements, cement basket type elements, cup type packer elements or inflatable packer elements. Also, such typical casing packer cementing shoes and stage cementing collars have employed separate ball seats and separate latch-down seats therein. Such typical prior art type devices are shown in U.S. Pat. Nos. 2602511, 2813589, 3131767, 3524502, 3527299, 3768556, 4469174, 4407369, and 4961465.

It is further typical to use cup type sealing element on various types of tools used in wells. Such tools having cup type sealing elements are described in U.S. Pat. Nos. 1563162, 2200943, 2305282, 2546978, 2672199, 2585706, 2674315, 2829717, 3010518, 3391743, 4149566 and 4431058.

STATEMENT OF THE INVENTION

The invention relates to an improved cup type packer cementing shoe comprising a single pump-out seat and all elastomeric sealing cups.

DESCRIPTION OF THE INVENTION

Figure 1:
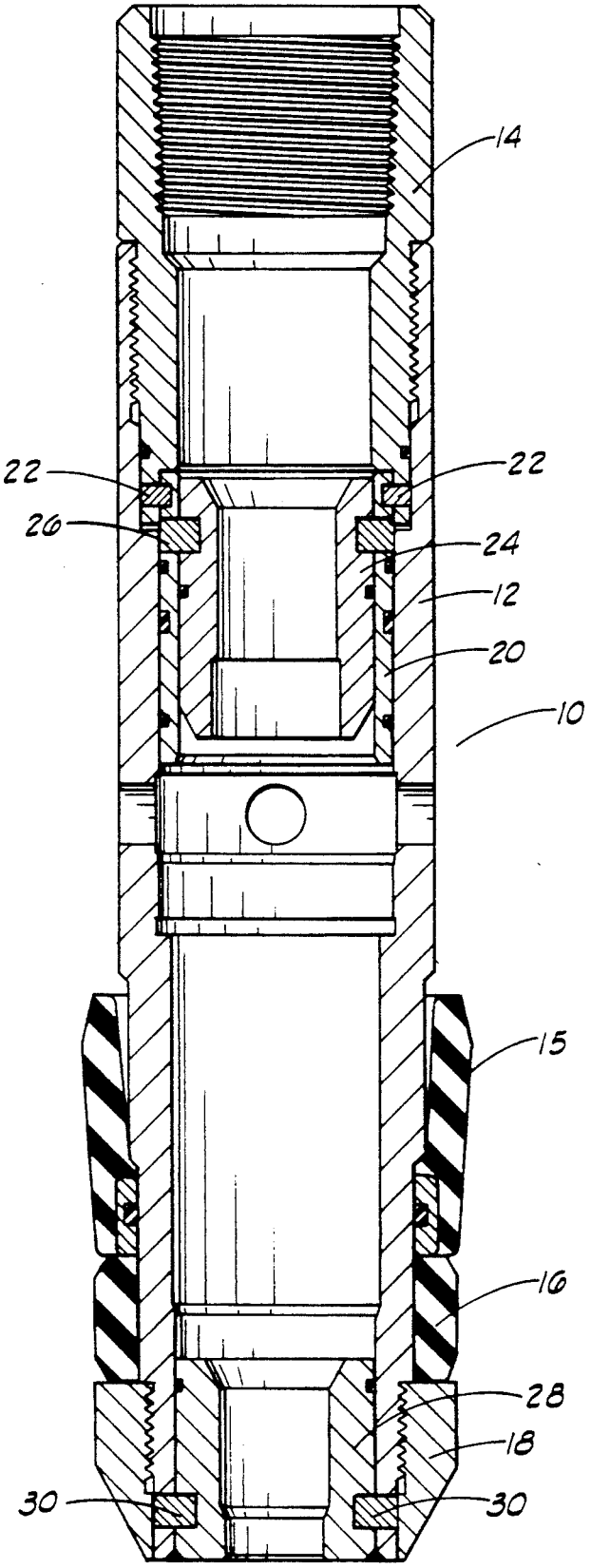
FIG. 1 PRIOR ART
FIG. 1 is a cross-sectional view of a prior art cup type casing packer shoe.

Referring to drawing FIG. 1 a prior art cup type packer cementing shoe 10 is shown.

The prior art cementing shoe 10 comprises a housing 12, upper adapter 14 connected to housing 12 which is used to connect the shoe 10 to a casing string to be cemented into a well bore, metal reinforced rubber cup type packer element 15 located on housing 112, rubber packer element 16, retaining nut 18 secured to one end of housing 12 to retain the packer elements 15 and 16 on the housing 12, latch-down sleeve 20 retained in a first position within shoe 10 by means of shear pins 22, separate latch-down seat 24 retained in a first position within latch-down sleeve 20 by means of shear pins 26 and separate ball seat 28 retained within housing 12 by means of shear pins 30.

As can be seen from drawing FIG. 1 the prior art shoe 10 comprises at least six (6) separate components each of which require machining of parts thereof for dimensional control of the parts to effectuate sealing and proper operation of the parts and the shoe 10.

Figure 2:
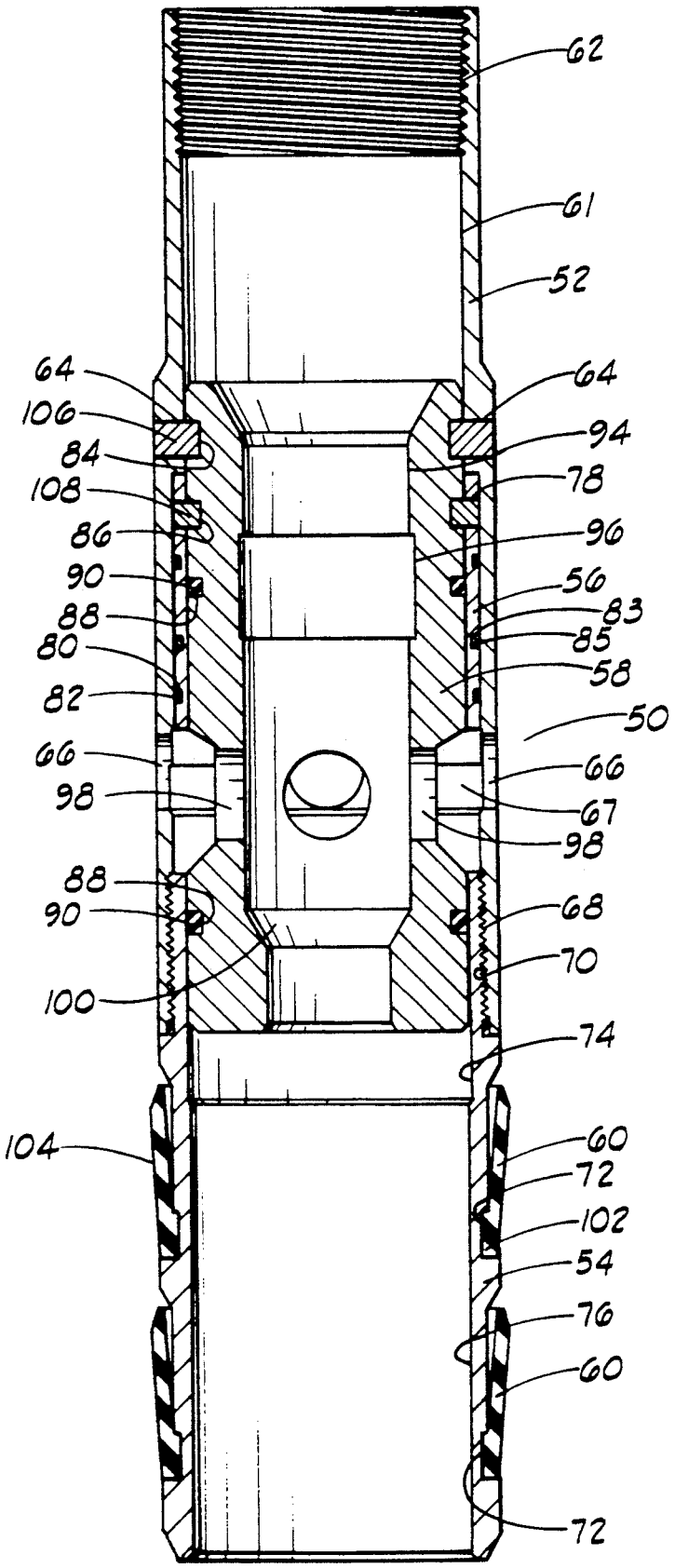
FIG. 2 is a cross-sectional view of the cup type casing packer shoe of this present invention.

Referring to drawing FIG. 2, the cup type casing packer shoe 50 of the present invention.

The shoe 50 comprises upper housing 52, lower housing 54, sleeve 56, latch-down plug and ball seat 58, and elastomeric packer cups 60.

The upper housing 52 comprises an elongated annular cylindrical member having a bore 61 therethrough, upper threaded bore 62 therein to secure the shoe 10 to a casing string to be cemented in a well bore, a first plurality of apertures 64 therethrough, a second plurality of apertures 66 therethrough, undercut bore 67 therein and lower threaded bore 68 therein.

The lower housing 54 comprises an elongated annular cylindrical member having threaded surface 70 which threadedly engages lower threaded bore 68 of upper housing 52, annular cup retaining recesses 72 therein, bore 74 partially therethrough and bore 76 partially therethrough.

The sleeve 56 comprises an annular cylindrical member having a plurality of apertures 78 therethrough, a plurality of annular recesses 80 in the exterior thereof having annular elastomeric seals 82 therein to sealingly engage a bore of upper housing 52 and annular recess 83 having, in turn, resilient lock ring 85 contained therein.

The latch-down plug and ball seat 58 comprises an elongated annular cylindrical member having annular release pin recess 84 in the exterior thereof, annular sleeve release pin recess 86 in the exterior thereof, annular recesses 88 in the exterior thereof having annular elastomeric seals 90 therein to sealingly engage the bore of sleeve 56 and a bore of lower housing 54 therein, latch down bores 94 and 96 therein, a plurality of apertures 98 therethrough and frusto-conical ball seat 100 therein.

The elastomeric packer cups 60 comprise all elastomeric material annular cylindrical members each having a lip 102 which engages recess 72 of lower housing 54 to retain the packer cup 60 thereon and each having a frusto-conical sealing lip 104 which sealingly engages the interior of the casing being previously cemented into the well bore. The cups 60 may be of any suitable elastomeric material, such as rubber.

A plurality of shear pins 106 having a portion of each retained in each first aperture 64 of upper housing 52 and annular recess 84 of sleeve 58 retain the latch-down plug and ball seat sleeve 58 in a first position in upper housing 52.

A plurality of shear pins 108 having a portion of each retained in aperture 78 of sleeve 56 and annular recess 86 of sleeve 58 retain the sleeve 56 in position with respect to the latch-down plug and ball seat sleeve 58.

OPERATION OF THE INVENTION

The cup type casing packer cementing shoe 50 of the present invention is installed on the end of a string of casing and run into the well bore.

To cause cement to exit through apertures 98 of latch-down plug and ball seat sleeve 58 and aperture 66 of upper housing 52 a ball is dropped to free fall through the string of casing until it seats on ball seat 100 of sleeve 58 thereby blocking fluid flow through the sleeve 58 and shoe 50 causing the fluid flow to be diverted through apertures 98 and 66.

When it is desired to block apertures 66 in upper housing 52, a suitable pump down latch plug is pumped through the casing into latch down bores 94 and 96 seating and sealingly engaging therein with the fluid pressure in the string of casing above the shoe 50 being increased until the shear pins 106 are sheared thereby allowing sleeve 56 and latch-down and ball seat 58 to move downwardly until the sleeve 56 abuts the upper shoulder of bore 76 of lower housing 54 and sleeve 56 blocks apertures 66 of upper housing 52. Shear pins 108 subsequently shear and the latch-down and ball seat 58 moves out the bottom of the shoe 50 thereby leaving an open bore through the shoe 50 thereby eliminating the need to drill the seat 58 out. The sleeve 56 remains in the shoe 50 being retained therein by means of resilient lock ring 85 being retained in undercut bore 67 of upper housing 52. As can be seen from the foregoing the cementing shoe of the foregoing offers simplicity of design, manufacture and operation. It offers all elastomeric sealing cups as well as a unitary latch-down plug and ball seat.

Thus, I claim:

1. A cup type casing packer cementing shoe used in cementing a string of casing in a well bore comprising:

an annular housing having one end adapted to be secured to the end of said string of casing, having a first plurality of apertures therethrough, having a second plurality of apertures therethrough, having a bore therethrough, having an undercut bore in the bore therein, and having one or more annular recesses on the exterior thereof;

an annular sleeve slidably, sealingly retained within the bore of the annular housing, the annular sleeve having a plurality of apertures therethrough and a bore therethrough;

a single piece annular latch-down plug and ball seat slidably, sealingly engaging the bore of the annular housing and the bore of the annular sleeve, the annular latch-down plug and ball seat having a first annular recess in the exterior thereof, having a second annular recess in the exterior thereof, having a plurality of apertures therethrough, and having a bore therethrough having in turn, a latch down portion and a ball seat portion therethrough;

one or more shear pins having a portion thereof extending into the first plurality of apertures in the annular housing and having a portion extending into the first annular recess in the exterior of the latch-down plug and ball seat;

one or more shear pins having a portion thereof extending into the apertures in the annular sleeve and having a portion extending into the second annular recess in the exterior of the annular latch-down plug and ball seat; and one or more elastomeric annular packer cups, each cup having a portion thereof retained within an annular recess in the exterior of the annular housing.

2. The cementing shoe of claim 1 wherein the annular housing comprises:

an annular upper housing having a first plurality of apertures therethrough, having a second plurality of apertures therethrough, and having a bore therethrough having, in turn, the upper portion of the bore being adapted to be secured to one end of said string of casing and having the lower portion of the bore being adapted to be secured to another portion of said cementing shoe; and an annular lower housing having a portion of the upper exterior end adapted to be secured to the lower portion of the bore of the annular upper housing, having one or more annular recesses on the exterior thereof, having a bore therethrough including a first portion having a bore and a second portion having a bore being smaller than that of the bore of the first portion.

3. The casing shoe of claim 2 wherein the annular sleeve comprises:

an annular sleeve having a bore therethrough, having a plurality of apertures therethrough, and having one or more annular recesses in the exterior surface thereof, each annular recess containing an annular elastomeric seal therein, and having another annular recess in the exterior surface thereof containing a resilient lock ring therein.

4. The casing shoe of claim 3 wherein the annular latch-down plug and ball seat comprises:

an annular latch-down plug and ball seat having one or more apertures therethrough, having a bore therethrough including first and second latch-down bore therethrough, the first latch down bore being smaller that the second latch down bore, and a frusto-conical ball seat, having a first annular recess in the exterior thereof, having a second annular recess in the exterior thereof, and having two or more annular recesses in the exterior thereof, each of these annular recesses having an annular elastomeric seal contained therein.

* * * * *